United States Patent [19]

Vydrin et al.

[11] 4,086,797

[45] May 2, 1978

[54] DEVICE FOR AUTOMATIC ADJUSTMENT OF A ROLL GAP BETWEEN WORK ROLLS IN MILL STAND

[76] Inventors: Vladimir Nikolaevich Vydrin, ulitsa Timiryazeva, 28, kv. 27; Vladimir Georgievich Dukmasov, ulitsa Soni Krivoi, 77, kv. 5; Garifulla Davlyatshin, prospekt Komsomolsky, 15, kv. 100, all of Chelyabinsk; Oleg Ivanovich Tischenko, prospekt Lenina, 6/2, kv. 6, Temirtau Karagandinskoi oblasti, all of U.S.S.R.

[21] Appl. No.: 797,076

[22] Filed: May 16, 1977

[51] Int. Cl.[2] ..... B21B 37/12

[52] U.S. Cl. ..... 72/20; 72/245

[58] Field of Search ..... 72/245, 19, 20, 237, 72/6

[56] References Cited

U.S. PATENT DOCUMENTS 3,427,839 2/1969 Neumann ..... 72/20

3,686,907 8/1972 Sokolov et al. ..... 72/20 X

*Primary Examiner*—Milton S. Mehr

*Attorney, Agent, or Firm*—Lackenbach, Lilling & Siegel

[57] ABSTRACT

The device for automatic adjustment of the roll gap consists of two similar operable parts arranged on each side of a mill stand, each part comprising a two-chamber hydraulic cylinder for prestressing the mill stand. The cylinder is fitted with two rods, one of which interacts with a bottom cross bar of the housing, the other one accommodating a load cell for absorbing a rolling force and being mounted so as not to be effected by the mill stand stress. One chamber of the two-chamber hydraulic cylinder communicates with a constant pressure fluid source and the other chamber communicates with a chamber of the load cell. The two-chamber hydraulic cylinder is fitted with a regulated valve, which has a throttle chamber in communication with a second chamber of the hydraulic cylinder and with an individual variable-pressure fluid source, and a control chamber combined with the chamber of the load cell.

1 Claim, 2 Drawing Figures

DEVICE FOR AUTOMATIC ADJUSTMENT OF A ROLL GAP BETWEEN WORK ROLLS IN MILL STAND

The present invention relates to rolling mill equipment and, more particularly, to a device for automatic adjustment of a roll gap between work rolls in a mill stand.

The invention is best suited for adaptation in rolling mills for strips or sheets of metal.

BACKGROUND OF THE INVENTION

There is known in the art a device for automatic adjustment of a roll gap in a mill stand, which comprises one-chamber hydraulic cylinders adapted for prestressing the mill stand and mounted under the bottom roll chocks.

The hydraulic cylinders are provided with an electrohydraulic system to control the pressure of a fluid being fed to said hydraulic cylinders from a high-pressure fluid source.

The aforesaid electrohydraulic system comprises electric load cells adapted to absorb a rolling force, load cells to register a mill stand prestressing force and servovalves fitted with electric circuit for their control.

The electric load cells for absorbing a rolling force are mounted under the stand housing screws and on top roll chocks.

The electric load cells for registering the mill stand prestressing force are arranged or mounted intermediate the top-housing separator and bottom roll chocks.

The servovalves together with their electric control circuit and high-pressure fluid sources are disposed or located outside the mill stand.

The afore-described device for automatic adjustment of a roll gap in a mill stand operates in the following manner.

During the rolling operation, the rolling force is varied and registered by the electric load cell.

The signal from this load cell is applied to the electrohydraulic system for controlling the fluid pressure in the hydraulic cylinders. As a result, the servovalve is operated to alter the fluid pressure in the hydraulic cylinders thereby altering the stand prestressing force. Therefore, by effecting the prescribed alteration of the stand prestressing force in accordance with the rolling force, the automatic adjustment of the roll gap within a preset range is assured.

The aforesaid prior-art device allows for substantially accurate adjustment of a roll gap in a mill stand.

It is to be understood, however, that the servovalves require a highly purified fluid (oil), otherwise, the servovalves become unstable in operation and the device looses its operating dependability.

Moreover, the servovalves are rather complex in construction, expensive to manufacture and difficult to operate. The valves, as well as their electric control circuit, require the attendance of highly qualified personnel.

There is also known a device for automatic adjustment of a roll gap in a mill stand, which comprises load cells for absorbing a rolling force which are not affected by the action of the two-chamber hydraulic cylinders for prestressing the mill stand. Each of the hydraulic cylinders is fitted with two rods, one of which rests upon the roll housing cross bar and the other one accommodates therein a hydraulic load cell. Resting against the latter in a chock formed with openings through which rods are extended, each rod having one end thrust up against the body of the two-chamber hydraulic cylinder and the other end thrust against the opposite chock. The two-chamber hydraulic cylinder communicates through one of its chambers with a constant-pressure fluid source and through its other chamber, directly with the load cell chamber and with a means for varying the amount of oil in said chambers.

The afore-described device operates in the following manner.

During the rolling operation, the load cells take up the rolling force with a resultant change of fluid pressure therein, which, in turn, causes a change of pressure in the chambers of the two-chamber hydraulic cylinders in communication with these load cells. As a result, the mill stand prestressing force will vary, while the fluid pressure in the chambers of the two-chamber hydraulic cylinders, communicating with the constant-pressure fluid source, will remain unchanged. The change in the mill stand prestressing force will cause a change in the mill stand deformation and, consequently, in a roll gap between the working rolls.

By selecting the device parameters, those for the two-chamber hydraulic cylinders and load cells, a definite relationship is obtained between the mill stand prestressing force and the rolling force, which allows for roll-gap automatic adjustment in the mill stand.

The setting of the described prior-art device is effected by an appliance for varying the amount of fluid in the inter-communicated chambers of the load cell and one of the chambers of the two-chamber hydraulic cylinder with the purpose of varying the rigidity of the load cell and that of the mill stand, respectively.

However, the device of the type described is incapable of maintaining a constant roll-gap profile between the working rolls during the rolling operation. The reason for this is that the decreasing gap between the chocks, results in a fluid overflow from the load cell chamber into the chamber of the two-chamber hydraulic cylinder in communication therewith. This overflow causes the displacement of the chocks together with the rolls, which makes impossible compensation for the deflection of the rolls.

SUMMARY OF THE INVENTION

It is, therefore, an object of the present invention to provide a device for automatic adjustment of a roll gap in a mill stand, which is simple in construction, reliable in operation and inexpensive to manufacture.

Another object of the invention is to provide a device for automatic adjustment of a roll gap in a mill stand, which will enable the use of a fluid (oil) with a purity degree characteristic similar to those of fluids employed in conventional hydraulic drives.

Still another object of the invention is to provide a device for automatic adjustment of a roll gap in a mill stand, which can be easily attended by personnel of average skill.

These and other objects of the invention are attained in a device, for automatic adjustment of a roll gap between working rolls in a mill stand, comprising two similar parts operating on an identical principle and arranged on each side of the mill stand. Each of said parts incorporates a two-chamber hydraulic cylinder intended for prestressing the mill stand and comprised of a shell and a piston fitted with two rods, one of the rods interacting with a roll housing cross bar, the other rod accommodating a load cell for absorbing a rolling force, said load cell being free from the effect of the mill stand stress. One chamber of said two-chamber hydraulic cylinder, communicates with a constant-pressure fluid source and the other chamber communicates with the load cell chamber. According to the invention, the device is provided with regulated pressure valves arranged in the two-chamber hydraulic cylinders, one valve for each hydraulic cylinder, a throttle chamber of said valves communicating with a second chamber of said hydraulic cylinders and with an individual variable-pressure fluid source, and a control chamber of said valves being combined with a chamber of load cells.

In the device of the invention, a change in the rolling force results in a change of the fluid pressure in the load cell chamber, and at the same time in the regulated pressure valve control chamber in communication therewith. As a result, the regulated pressure valve spool is displaced, thereby causing fluid to discharge through its throttle chamber. The variable-pressure fluid source, in direct communication with the throttle chamber, now operates to deliver a flow of fluid into the second chamber of the two-chamber hydraulic cylinder.

As a result, the fluid pressure is changed in the second chamber of the two-chamber hydraulic cylinders and, since the fluid pressure in the chambers of said cylinders communicating with the constant-pressure fluid source remains unchanged, it is the mill stand prestressing force that is subjected to change thereby altering the roll gap between the rolls in the mill stand.

Thus, it is through a proper selection of parameters for the two-chamber hydraulic cylinders, load cells and regulated pressure valves, that there is attained, just like in the prior-art device, a definite variation in the stand prestressing force depending on the rolling force, thus enabling automatic roll gap adjustment.

In addition, by combining in the herein proposed device the control chamber of the regulated pressure valve with the load cell chamber, it became possible to prevent the overflow of fluid from the load cell into the chamber of the two-chamber hydraulic cylinder in communication therewith, which results in the immobile or unchanged position of the roll chocks.

Such arrangement permits of compensation for the mill stand deformation ensuing from a change in the rolling force from the outset of the device operation, and thereby increases the roll-gap adjustment range.

The device of the invention features a high operating reliability, simplicity of construction and a low manufacturing cost. It is likewise easy in operation and readily serviced by attendants of average skill.

In addition, the hydraulic cylinders, load cells and regulated pressure valves employed in said device enable the use of a fluid (oil) with a purity degree characteristic similar to that used in conventional hydraulic drives.

The invention will now be explained in greater detail with reference to a specific embodiment thereof, taken in conjunction with the accompanying drawing.

DETAILED DESCRIPTION OF THE INVENTION

Figure 1:
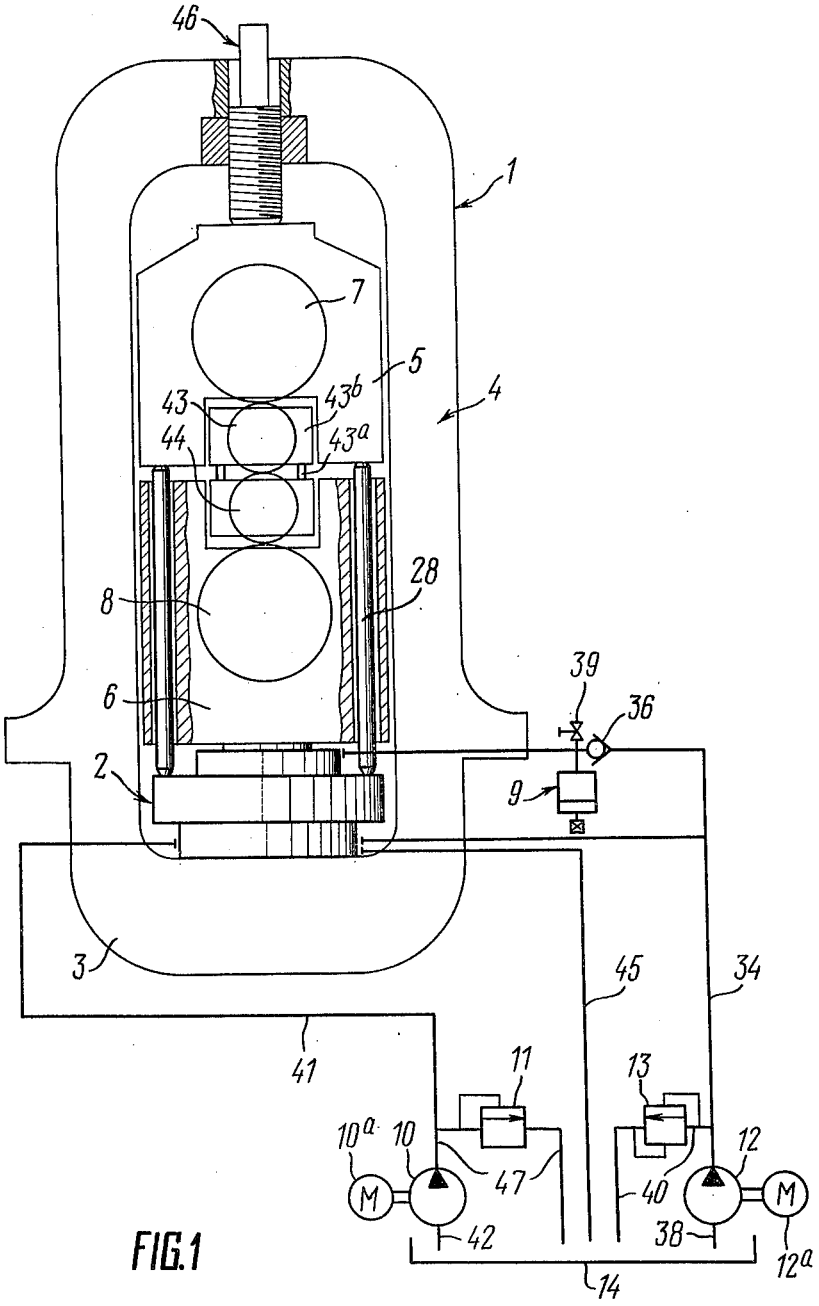
FIG. 1 is a general view of a device for automatic adjustment of a roll gap between working rolls, arranged on a mill stand, according to the invention.
Figure 2:
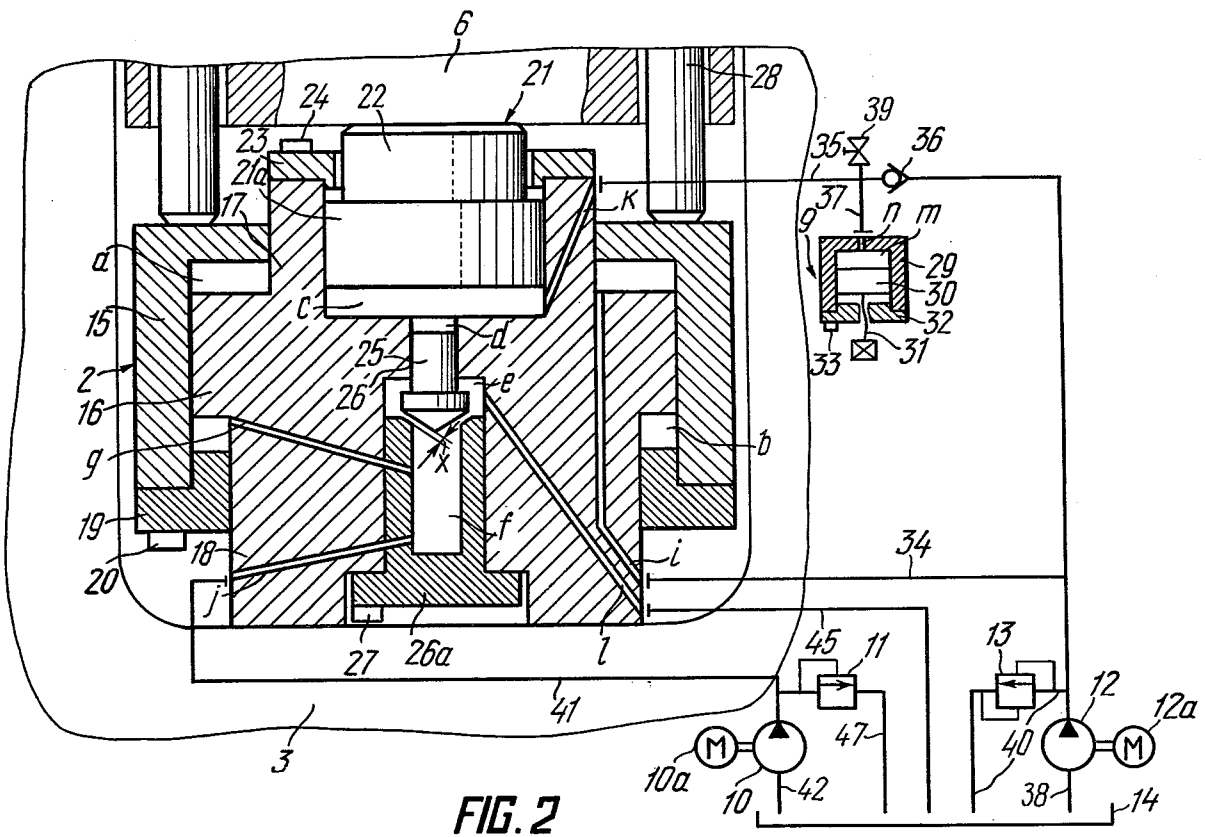
FIG. 2 is a longitudinal sectional view of a two-chamber hydraulic cylinder.

Referring now to FIGS. 1 and 2, there is illustrated a device for automatic adjustment of a roll gap in a mill stand 1, as viewed from one side of the stand, which comprises a two-chamber hydraulic cylinder 2 arranged on each side of the mill stand, each cylinder interacting with a bottom cross bar 3 of a roll housing 4, and with chocks 5 and 6 of a top backup roll 7 and a bottom backup roll 8, respectively. The two-chamber hydraulic cylinder serves to produce a force Q for prestressing the mill stand 1. The device is also comprised of a means 9 for varying the rigidity of the mill stand 1, which is connected with the hydraulic cylinder 2; a pump 10 with an electric drive **10*a* for varying the oil (fluid) pressure fitted with a safety valve 11, and a pump 12 with an electric drive 12*a*; one for two hydraulic cylinders 2. The pump is used to build up pressure in the fluid delivery line, the pressure being kept constant by means of a pressure valve 13**.

The pumps 10 and 12 are connected through pressure lines with the two-chamber hydraulic cylinder 2 and an oil receiver 14.

The two-chamber hydraulic cylinder 2 has a shell 15, which accommodates in its bore a piston 16 fitted with an upper rod 17 and a lower one 18, and a cover 19 fixed to the shell 15 by screws 20.

Defined in the two-chamber hydraulic cylinder 2 by the piston 16, the shell 15 and the upper rod 17 is a chamber "*a*", and defined by the piston 16, the cover 19 and the lower rod 18 is a chamber "*b*". The chambers are sealed with packings (not shown).

The piston 16 accommodates in its upper bore a piston **21*a*** forming, together with a chamber "*c*", a hydraulic load cell 21. The rod 22 of the piston **21*a* extends through a cover 23 of the load cell 21 fixed to the upper rod 17 by screws 24. In its mid-bore the piston 16 accommodates a valve spool 25 which forms together with a cover 26*a* a regulated pressure valve 26** having a control chamber "*d*" combined with the chamber "*c*" of the load cell. The combined chambers "*c*" and "*d*" are sealed with packings /not shown/.

The cover **26*a* is accommodated in the lower bore of the piston 16 and is secured by screws 27 to the lower rod 18 of the piston 16**.

The valve 25 defines together with the piston 16 and the cover **26*a*** a discharge chamber "*e*", and together with the cover **26*a* the value 25** defines a throttle chamber "*f*" of the regulated pressure valve 26, said chamber communicating through a channel "*g*" with the chamber "*b*" of the two-chamber hydraulic cylinder 2.

To provide oil into or out of the chamber "*a*" of the two-chamber hydraulic cylinder 2, into or out of the throttle chamber "*f*" of the regulated pressure valve 26, combined with the chamber "*b*" of the cylinder 2, and into or out of the chamber "*c*" of the load cell 21, in communication with the control chamber "*d*" of the pressure valve 26, and out of the discharge chamber "*e*", the body of the piston 16 is formed with channels *i*, *j*, *k* and *l*, respectively.

The two-chamber hydraulic cylinder 2 interacts with the bottom cross bar 3 of the roll housing 4 through the lower rod 18 of the piston 16; the cylinder interacts with the chock 6 of the bottom backup roll 8 through the rod 22 of the piston **21*a*** and through a layer of oil in the chamber "*c*" of the load cell 21 between the cover 23 and the piston 16; the cylinder interacts with the chock 5 of the top backup roll 7 through the shell 15 and through rods 28 accommodated in the bores of the chock 6, the upper ends of the rods being thrust against the chock 5 and the lower ends being thrust against the shell 15.

The means 9 intended for varying the rigidity of the mill stand 1 is made in the form of a hydraulic cylinder comprising a shell 29 and a piston 30 fitted with a screw rod 31 driven in a cover 32 secured to the shell 29 by screws 33. The piston 30 and the shell 29 define a working chamber "*m*" of the means 9. The shell 29 is formed with a channel "*n*" for the flow of oil into and out from the working chamber "*m*".

The chamber "*a*" of the two-chamber hydraulic cylinder 2 is in communication with the constant-pressure oil pump 12 through the channel "*i*" and a line 34. The chamber "*c*" of the load cell 21, combined with the control chamber "*d*" of the regulated pressure valve 26, communicates with the pump 12 through the channel "*k*", the line 34 and a line 35, and a non-return valve 36, and with the working chamber "*n*" of the means 9 through a line 37 connected to the line 35.

The oil flows into the pump 12 by gravity along a line 38 from the receiver 14 and is pumped into the chambers and lines with a pressure of "$q_o$" which is maintained constant by the pressure valve 13. It is to be understood that the air, or a mixture of oil and air, can be readily discharged from the chambers and lines together with the oil into the receiver 14 along a line (not shown) by opening a valve 39.

Excess oil of the pump 12, when all the chambers and lines are filled (the valve 39 in shut-off position), is discharged into the receiver 14 along a line 40 through the pressure valve 13 which operates to keep constant a prescribed oil pressure [$q_o$ = const.] during operation of the pump 12.

The throttle chamber "*f*" of the regulated pressure valve 26, combined with the chamber "*b*" of the two-chamber hydraulic cylinder 2 through the channel "*g*", communicates with the variable-pressure oil pump 10 through the channel "*j*" and a line 41. The oil pressure in the combined chambers and lines, the oil being pumped thereinto by the pump 10, into which it flows by gravity along a line 42 from the receiver 14, increases during the oil flow from the throttle chamber "*f*" of the regulated pressure valve 26 through a slot "*x*", defined by the spool 25 and the cover 26, and into the discharge chamber "*e*". When there is no metal strip passing between the rolls 43 and 44 of the mill stand 1, the pressure of the pump 10 equals "$q_o$" of the pump 12. The balance in pressure stems from the equilibrium condition of the spool 25 with areas F*f* and F*d*, defined respectively by the spool in the throttle chamber "*f*" and in the control chamber "*d*" of the regulated pressure valve 26, being equal.

From the discharge chamber "*e*" the oil passes through the channel "*l*" in line 45 and into the receiver 14.

Thus, all chambers of the device units and lines, in the absence of a metal strip between the roll 43 and 44 of the mill stand 1, are filled with oil under a pressure equal to $q_o$.

As a result of this pressure, a part of the mill stand 1 (the roll housing 4, a screw-down gear 46 and the chock 5 of the top backup roll 7) is prestressed by force "*Q*", created by the oil pressure $q_o$ in the chambers "*a*" and "*b*" of the two-chamber hydraulic cylinder 2, under the action of which said part of the mill stand is subjected to a deformation "$\delta h$".

Therewith, the chock 6 of the bottom backup roll 8, resting upon the rod 22 of the piston 21*a* of the load cell 21, is rendered immobile, which is due to the fact that the piston is in a state of equilibrium resulting from the force created by the pressure "$q_o$" in the chamber "*c*" of the load cell at one side, and by the weight of the chock 6, the rolls 8, 43 and 44 (taking into account the thrust force of the chocks of the working rolls), and by the reaction at the cover 23 at the other side.

Before a metal strip is fed, the roll gap between the working rolls 43 and 44 of the mill stand 1 is set by the screw-down gear 46. The roll-gap profile is made equal to the sum of the and deformation "$\delta n$" of the prestressed part gap "*h*", not loaded by the rolling force "P"√ of the mill stand.

The herein proposed device operates in the following manner.

While a metal strip is being advanced between the working rolls 43 and 44 of the mill stand 1, there originates a rolling force "P" acting upon the elements of the stand 1 and on the piston 21*a* of the load cell 21 through the chock 6 of the backup roll 8. The resultant elastic expansion of the mill stand causes the roll gap to additionally increase to $h + \delta h$, the roll-gap profile being set prior to the rolling operation to a value of $\delta h_1$. The value $\delta h_I$ of the stand elastic expansion corresponds to the rolling force "P", value of which slightly exceeds that of the reaction at the cover 23, acting on the piston 21*a* of the load cell 21. With an increase in the rolling force "P" due to the reaction at the cover, there commences the roll-gap adjustment between the working rolls 43 and 44, i.e. the increment due to the stand deformation ensuing from the variation in the rolling force will be compensated for the deformation of a part of the mill stand, ensuing from the variation in the mill stand prestressing force. As a result, the oil pressure will increase in the combined chamber "*c*" of the load cell 21 and the control chamber "*d*" of the regulated pressure valve 26. The oil pressure will also increase in the channel "*k*", in the lines 35 and 37, as well as in the working chamber "*m*" of the appliance 9.

The oil pressure increase will cause the non-return valve to shut, whereby a closed chamber will be formed by the chamber "*c*" of the load cell 21, the control chamber "*d*" of the regulated pressure valve 26 and the working chamber "*m*" of the means 9. The closed chamber will be further hereinbelow referred to as "chambers *c* — *d* — *m*". The oil pressure in this closed chamber is proportional to the rolling force "P" with the value thereof exceeding $q_o$.

The oil pressure increase in the closed chamber will disturb the state of equilibrium of the spool 25 thereby causing its displacement towards the cover 26*a*, which will result in the narrowing of the slit "*x*" between the spool 25 and the cover 26*a* As a result of this narrowing, the amount of oil flowing from the throttle chamber "*f*" through the slit "*x*" into the discharge chamber "*e*" will decrease, thereby increasing the pressure of the oil, pumped by the pump 10, in the throttle chamber "*f*" and the chamber "*b*" of the hydraulic cylinder 2, the two chamber communicating with each other through the channel "*g*".

With the increase of the oil pressure in the chamber "*b*" of the hydraulic cylinder 2, the pressure $q_o$ in the chamber "*a*" of this hydraulic cylinder being unchanged, the mill stand prestressing force, created by the hydraulic cylinder 2, will be changed to result in the decreased deformation of the mill stand section.

Through appropriate selection of parameters, as will be shown herein below, it is possible to compensate for the increased deformation of the mill stand, ensuing from the variation in the rolling force, by the increased deformation of the mill stand section, ensuing from the variation in its prestressing force. As a result, the roll gap between the working rolls will be held constant regardless of fluctuations in the rolling force "P".

With the metal strip issuing from the working rolls, the oil pressure in the closed chamber, "chambers *c—d—m*", will decrease.

When the value of this pressure falls below $q_o$, the chambers of the aforesaid closed chamber will be brought into communication with the pump 12 through the non-return valve 36. The resultant oil pressure in the closed chamber will equal $q_o$. Consequently, the pressure built up by the pump 12 will likewise equal $q_o$.

Therefore, all chambers of the two-chamber hydraulic cylinder and the fluid pressure lines will be filled with oil under a pressure of $q_o$, the described device being set for the next operating cycle.

The device parameters are selected in the following manner.

The roll gap varies with the rolling force during the rolling operation mainly at the expense of the mill stand deformation. To keep the roll gap constant, it is necessary that the mill stand deformation should be not affected by a change in the rolling force P.

Starting from the moment of formation of the closed chamber, "chambers *c—d—m*", the roll gap between the rolls is maintained constant by the device of the invention, which operates in such a manner that an increment $\delta h_I$ of the mill stand deformation ensuing from a variation $\delta P$ in the rolling force P is compensated for by an increment $\delta h$ of the deformation of the mill stand section, ensuing from a variation $\delta Q$ of the mill stand prestressing force Q, expressed by the equation:

$$\frac{\delta P}{K_1} - \frac{\delta Q}{K} = 0 \quad (1),$$

where

K and $K_1$ are rigidity factors respectively of a part of the mill stand (the roll housing, screw-down gear, chocks of the top backup roll) loaded by force Q and that of the entire mill stand together with the hydraulic cylinder and the load cell.

From the equation (1) it follows that an increment $\delta Q$ should be proportional to an increment $\delta P$, according to the equation:

$$\delta Q = \delta P \frac{K}{K_1} \quad (2)$$

A change in the force Q by the value of $\delta Q$ is caused by a change in the oil pressure in the pump 10 by a value of $Qq_I$ and, consequently, in the chamber "*b*" of the hydraulic cylinder. The pressure $q_o$ in the chamber "*a*" of the hydraulic cylinder will remain unchanged.

$$\delta Q = \delta q_1 \cdot Fb \quad (3)$$

where

F*b* is the area of the piston of the hydraulic cylinder in the chamber "*b*".

Value $\delta q_I$ is determined from the equilibrium condition of the spool 25, which is expressed as follows:

$$\delta q \cdot Fd - \delta q_1 F_f = 0 \quad (4)$$

where $\delta q$ is the increment ensuing from the oil pressure in the closed chamber, "chambers *c—d—m*";

$\delta q_1$ is the increment ensuing from the pressure in the pump 10, and, consequently, in the chamber "*b*" of the hydraulic cylinder.

A change in pressure by a value of $\delta q$" in said closed chamber depends on a change of the rolling force P by a value of $\delta P$ $$\delta q = \frac{\delta P}{2F_c} \quad (5),$$

where $F_c$ is the area of the piston of the load cell.

Substituting the expression (5) into the equation (4), we find:

$$\delta q_1 = \frac{\delta P}{2F_c} \frac{Fd}{Ff} \quad (6)$$

Substituting the expression (6) into the equation (3), we find increment $\delta Q$ ensuing from the mill stand prestressing force Q:

$$\delta Q = \frac{P}{2Fc} \frac{Fd \cdot Fb}{Ff} \quad (7).$$

It is seen from the equations (2) and (7) that their left-hand parts are equal, therefore, simultaneous solution of these equations will give $$\frac{Fd \cdot Fb}{2Fc \cdot Ff} = \frac{K}{K_1} \quad (8).$$

The expression (8) is a necessary condition for fulfilling the equation (1), whereby the mill stand deformation ensuing from a change in the rolling force P will be compensated for by the deformation of the mill stand section due to a change in the prestressing force Q, which will result in that the roll gap between the working rolls, adjusted by the device of the invention, will remain unchanged.

For fulfilling the condition (8), it is important to find the area F*c* of the piston 21*a* of the load cell 21, which is determined from the condition of the maximum allowable rolling force $P_{max}$, and the maximum allowable oil pressure $q_{max}$ in the load cell chamber, according to the equation:

$$Fc = \frac{P_{max}}{2 \cdot q_{max}} \quad (9).$$

Areas F*d* and $F_f$ are selected according to the delivery rate of a pump 10, and area $F_b$ is calculated so as to permit fulfilment of the condition (8). The maximum pressure of the pump 10 is selected so as to be equal to the maximum oil pressure in the chamber "*c*" of the load cell 21.

Maximum allowable pressure of the pump is adjusted by the safety valve 11. If the pressure goes beyond its set limit, the excess oil, pump by the pump 10, will be caused to flow along the lines 41 and 47 through the safety valve 11 into the receiver 14.

The oil pressure $q_o$, built up by the pump 12, depends on a value of the rolling force $P_{min}$, the action of which induces the roll-gap adjustment operation.

The value of this pressure load is calculated according to the equation $$q_o = \frac{P_{min}}{2Fc}$$

and is set by the pressure valve 13.

The area of the piston of the hydraulic cylinder in the chamber "*a*" is calculated from the equilibrium condition of the hydraulic cylinder shell at maximum allowable pressure $q_{max}$ in the chamber "*b*"

$$q_o \mathrm{Fa} - q_{max} \cdot \mathrm{F}_b = 0 \qquad (10)$$

From the equation (10) we find F*a*

$$Fa = \frac{q_{max}}{q_o} F_b \qquad (11).$$

Initial values used for selecting the hereinbefore mentioned parameters of the proposed device are, according to the equation (8), the rigidity factor K, denoting the rigidity of the mill stand section loaded by force Q, and the rigidity factor "$K_1$", denoting the rigidity of the mill stand together with the hydraulic cylinder and the load cell, depending on an amount of oil in the closed chamber defined by the chamber "*c*" of the load cell 21, the control chamber "*d*" of the regulated pressure valve 26 and the working chamber "*m*" of the appliance 9.

With calculated values of "K" and "$K_1$" being varied from their true values, the setting of the herein disclosed device is effected through the means 9 by changing the volume of its working chamber "*m*", thereby setting up a new value for the aforesaid closed chamber. As a result, the rigidity of the load cell, and, consequently, that of the entire mill stand, is changed.

The equation (8) is reduced to the form:

$$\frac{1}{K_1} = \frac{1}{K} \; \frac{Fd \cdot Fb}{2Fc \cdot Ff} \qquad (12).$$

The left-hand part of the expression (12) is determined from the equation:

$$\frac{1}{K_1} = \frac{1}{K_2} + \frac{1}{K_3} \qquad (13),$$

where $K_2$ is the rigidity of the mill stand together with the hydraulic cylinder 2 without oil in the chamber "*c*" of the load cell 21; and $K_3$ is the rigidity of oil within the closed chamber, it being reduced to the area of the load cell piston. In the equation (13), the oil rigidity factor equals $$K_3 = \frac{Fc^2}{\beta W} \qquad (14),$$

where $\beta$ is the oil compressibility factor (inverse of the modulus of oil compression).

W is the amount of oil in the closed chamber.

Substituting the expression (14) into the equation (13), we find $$\frac{1}{K_1} = \frac{\beta W}{Fc^2} + \frac{1}{K_2} \qquad (15).$$

It is seen from the equations (12) and (15) that their left-hand parts are equal.

Simultaneous solution of these two equations will give us the value W $$W = \left(\frac{1}{K} \cdot \frac{Fd \cdot Fb}{2Fc\,Ff} - \frac{1}{K_2}\right) \cdot \frac{F^2C}{B} \qquad (16).$$

The equation (16) is the principal condition for determining the amount of oil in the closed chamber formed by the chamber "*c*" of the load cell, the control chamber "*d*" of the regulated pressure valve 26 and the working chamber "*m*" of the appliance 9, at given parameters of K, $K_2$, F*d*, F*b*, $F_c$, $F_f$ and $\beta$.

With one of said parameters being varied, for example, the actual rigidity K and that of $K_2$ differing from the calculated values thereof, a value of W can be adjusted at will with the aid of the means 9 by causing its piston 30 to travel relative to the piston 29, the piston 30 being pushed by the screw rod 31. Such piston displacement results in the regulation of oil with the amount thereof in the closed chamber being brought in conformity with given parameters according to the expression (16), thereby varying the ridigity factor $K_3$ and, consequently, the rigidity factor $K_1$ which should satisfy the conditon given in the equation (8).

What is claimed is:

1. A device for automatic adjustment of a roll gap between working rolls in a mill stand, comprising two similar parts operating on an identical principle, one part being arranged on each side of the mill stand, each of said parts comprising a two-chamber hydraulic cylinder for prestressing the mill stand, said hydraulic cylinder including a shell and a piston fitted with two rods, a first of said rods interacting with a roll housing cross bar, said shell interacting with a support member of one of said working rolls; a load cell for absorbing a rolling force arranged within a second of said piston rods of said hydraulic cylinder and being free from the effect of the mill stand prestressing force, said load cell interacting with a support member of the other working roll, a chamber of said load cell communicating with a first of the chambers of said two-chamber hydraulic cylinder; a regulated pressure valve arranged within said two-chamber hydraulic cylinder and having a throttle chamber communicating with a second chamber of said hydraulic cylinder and a control chamber combined with the chamber of said load cell; a variable-pressure fluid source arranged outside said mill stand and communicating with the throttle chamber of said regulated pressure valve to maintain therein a variable fluid pressure proportional to the rolling force; and a constant-pressure fluid source, for each operable parts of said device, communicating with the chamber of said load cell and with the second chamber of said two-chamber hydraulic cylinder.

* * * * *